US011072837B2

(12) United States Patent
Nakamura et al.

(10) Patent No.: US 11,072,837 B2
(45) Date of Patent: Jul. 27, 2021

(54) MARTENSITIC STAINLESS STEEL SHEET

(71) Applicant: JFE STEEL CORPORATION, Tokyo (JP)

(72) Inventors: Tetsuyuki Nakamura, Tokyo (JP); Shin Ishikawa, Tokyo (JP); Reiko Sugihara, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 358 days.

(21) Appl. No.: 16/341,450

(22) PCT Filed: Oct. 6, 2017

(86) PCT No.: PCT/JP2017/036512
§ 371 (c)(1),
(2) Date: Apr. 12, 2019

(87) PCT Pub. No.: WO2018/074271
PCT Pub. Date: Apr. 26, 2018

(65) Prior Publication Data

US 2019/0264298 A1 Aug. 29, 2019

(30) Foreign Application Priority Data

Oct. 18, 2016 (JP) ..... JP2016-204688

(51) Int. Cl.
*C22C 38/00* (2006.01)
*C22C 38/02* (2006.01)
(Continued)

(52) U.S. Cl.
CPC ..... *C21D 9/46* (2013.01); *C21D 1/25* (2013.01); *C21D 6/004* (2013.01); *C21D 6/005* (2013.01);
(Continued)

(58) Field of Classification Search
CPC ..... C22C 38/42; C22C 38/44; C22C 38/46; C22C 38/48; C22C 38/50; C22C 38/52; C22C 38/54
See application file for complete search history.

(56) References Cited

U.S. PATENT DOCUMENTS 5,178,693 A 1/1993 Miyakusu et al.
8,333,849 B2 12/2012 Yamauchi et al.
(Continued)

FOREIGN PATENT DOCUMENTS

CN 102449181 A 5/2012
CN 105189801 A 12/2015
(Continued)

OTHER PUBLICATIONS

J Plat Pat Machine translation of JP 2006-291240 (Year: 2021).*
(Continued)

*Primary Examiner* — Patricia L. Hailey
*Assistant Examiner* — Christopher D. Moody
(74) *Attorney, Agent, or Firm* — Kenja IP Law PC

(57) ABSTRACT

A martensitic stainless steel sheet comprises a chemical composition containing, in mass %, C: 0.035% to 0.090%, Si: 0.01% to 1.0%, Mn: 0.01% to 0.90%, P: 0.050% or less, S: 0.050% or less, Cr: 10.0% to 14.0%, Ni: 0.01% to 0.40%, Al: 0.001% to 0.50%, V: 0.05% to 0.50%, and N: 0.050% to 0.20%, with the balance being Fe and inevitable impurities, wherein a content of C and a content of N in the chemical composition satisfy C %+N % 0.10% and N % C %, the number of precipitates with a major axis length of 200 nm or more in a surface layer of the martensitic stainless steel sheet is 25 or less per 100 $\mu m^2$, and the martensitic stainless steel sheet has a tensile strength of 1300 MPa or more, a proof stress of 1100 MPa or more, and an elongation of 8.0% or more.

8 Claims, 3 Drawing Sheets

(51) Int. Cl.

| | |
|---|---|
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C21D 9/46*** | (2006.01) |
| ***C21D 6/00*** | (2006.01) |
| ***C21D 8/02*** | (2006.01) |
| ***C21D 1/25*** | (2006.01) |
| ***C21D 8/04*** | (2006.01) |
| *C21C 7/10* | (2006.01) |

(52) U.S. Cl.

CPC ..... *C21D 6/007* (2013.01); *C21D 6/008* (2013.01); *C21D 8/0205* (2013.01); *C21D 8/0426* (2013.01); *C21D 8/0436* (2013.01); *C21D 8/0463* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21C 7/10* (2013.01); *C21D 2211/008* (2013.01)

(56) References Cited

U.S. PATENT DOCUMENTS

| | | | |
|---|---|---|---|
| 8,607,941 | B2 | 12/2013 | Yamauchi et al. |
| 9,267,197 | B2 | 2/2016 | Beguinot et al. |
| 10,246,765 | B2 | 4/2019 | Omura et al. |
| 2005/0274436 | A1* | 12/2005 | Kondo ..... C22C 38/46 148/326 |
| 2016/0281189 | A1 | 9/2016 | Fujisawa et al. |
| 2017/0253945 | A1 | 9/2017 | Teraoka et al. |
| 2018/0112285 | A1 | 4/2018 | Nakamura et al. |

FOREIGN PATENT DOCUMENTS

| | | | |
|---|---|---|---|
| EP | 2439304 | A1 | 4/2012 |
| EP | 2947170 | A1 | 11/2015 |
| JP | S5913052 | A | 1/1984 |
| JP | H0356621 | A | 3/1991 |
| JP | H07316740 | A | 12/1995 |
| JP | H08319519 | A | 12/1996 |
| JP | 2001140041 | A | 5/2001 |
| JP | 2002038243 | A | 2/2002 |
| JP | 2002097554 | A | 4/2002 |
| JP | 2005054272 | A | 3/2005 |
| JP | 2006097050 | A | 4/2006 |
| JP | 2006169582 | A | 6/2006 |
| JP | 2006291240 | A | 10/2006 |
| JP | 2009280912 | A | 12/2009 |
| JP | 2016065301 | A | 4/2016 |
| KR | 1020120023096 | A | 3/2012 |
| WO | 2006016043 | A2 | 2/2006 |
| WO | 2015107608 | A1 | 7/2015 |
| WO | 2016170761 | A1 | 10/2016 |

OTHER PUBLICATIONS

Jan. 9, 2018, International Search Report issued in the International Patent Application No. PCT/JP2017/036512.

Mar. 11, 2021, Office Action issued by the China National Intellectual Property Administration in the corresponding Chinese Patent Application No. 201780063828.3 with English language concise statement of relevance.

Shuhua Li et al., Heat treatment technical experiences, 2015, pp. 428-430.

Sep. 16, 2020, Office Action issued by the Korean Intellectual Property Office in the corresponding Korean Patent Application No. 10-2019-7013952 with English language concise statement of relevance.

Oct. 4, 2019, the Extended European Search Report issued by the European Patent Office in the corresponding European Patent Application No. 17861696.7.

Jun. 18, 2020, Office Action issued by the China National Intellectual Property Administration in the corresponding Chinese Patent Application No. 201780063828.3 with English language search report.

* cited by examiner

Cr carbonitride(major axis length:262nm)

Cr and V complex carbonitride(major axis length:41nm)

Cross section(bead portion)

MARTENSITIC STAINLESS STEEL SHEET

TECHNICAL FIELD

The present disclosure relates to a martensitic stainless steel sheet excellent in strength, workability, and corrosion resistance.

BACKGROUND

Gaps between two parts of the exhaust system of an automobile are sealed by seal parts called gasket in order to prevent leakage of exhaust gas, coolant, lubricating oil and the like. The gap between the parts widens or narrows according to the pressure variation in pipes and the like, and the gasket needs to exhibit seal performance in either case, and accordingly a convex portion called bead is shaped on the gasket. Since the bead is repeatedly compressed and relaxed during use, high tensile strength is required. Moreover, the gasket is subjected to hard working depending on the shape of the bead, and thus the material for the gasket is required to have excellent workability. Furthermore, the gasket is exposed to exhaust gas, coolants, and the like during use, and thus need to be resistant to corrosion. If the corrosion resistance of the material for the gasket is insufficient, the gasket may fracture due to corrosion.

Conventionally, austenitic stainless steel such as SUS301 (17 mass % Cr-7 mass % Ni) and SUS304 (18 mass % Cr-8 mass % Ni) having both strength and workability at high level has been widely used as gasket materials. However, austenitic stainless steel has a problem in terms of material cost, because it contains a large amount of Ni which is an expensive element. Austenitic stainless steel also has a problem of high stress corrosion crack sensitivity.

In view of this, martensitic stainless steel such as SUS403 (12 mass % Cr-0.13 mass % C) and stainless steel having a multi-phase structure including martensite have been proposed as stainless steel that is inexpensive because of its low Ni content and can be strengthened by quenching treatment.

For example, JP 2002-38243 A (PTL 1) discloses martensitic stainless steel and martensite-ferrite dual-phase stainless steel having improved fatigue resistance as a result of performing quenching treatment in a nitrogen-containing atmosphere to nitride the surface layer and form austenite phase.

JP 2005-54272 A (PTL 2) discloses martensite-ferrite dual-phase stainless steel having both hardness and workability as a result of heating to an austenite-ferrite dual-phase temperature range and performing quenching.

JP 2002-97554 A (PTL 3) discloses multi-phase structure stainless steel in which a surface layer consists of martensite and retained austenite phase and an inner layer consists of martensite single phase as a result of performing quenching heat treatment in a nitrogen-containing atmosphere.

JP H3-56621 A (PTL 4) discloses martensite-ferrite dual-phase stainless steel having improved spring property as a result of performing aging treatment after multi-phase heat treatment.

JP H8-319519 A (PTL 5) discloses martensite-ferrite dual-phase stainless steel having intended hardness as a result of providing the cold rolling ratio.

JP 2001-140041 A (PTL 6) discloses stainless steel in which a surface layer is martensite and retained austenite dual phase.

JP 2006-97050 A (PTL 7) discloses stainless steel in which a nitrogen compound is precipitated in a surface layer by causing SUS403 or the like to absorb nitrogen.

JP H7-316740 A (PTL 8) discloses multi-phase structure stainless steel in which a surface layer of at least 1 μm in depth from the outermost surface is covered with a layer of martensite single phase.

CITATION LIST

Patent Literatures

PTL 1: JP 2002-38243 A
PTL 2: JP 2005-54272 A
PTL 3: JP 2002-97554 A
PTL 4: JP H3-56621 A
PTL 5: JP H8-319519 A
PTL 6: JP 2001-140041 A
PTL 7: JP 2006-97050 A
PTL 8: JP H7-316740 A

SUMMARY

Technical Problem

However, the stainless steels in PTL 1 to PTL 3 all have high C content to enhance strength, and therefore have a problem with workability.

The stainless steel in PTL 4 has desired hardness in the case where the C content is high or the Ni content is high. However, high C content causes insufficient workability, and high Ni content causes not only lower workability but also higher cost.

The stainless steel in PTL 5 deteriorates in workability as a result of cold rolling. The stainless steels in PTL 6 and PTL 7 have insufficient workability. The stainless steels in PTL 5 to PTL 7 thus fail to achieve both strength and workability sufficiently.

The stainless steel in PTL 8 has poor workability because the C content is high, or cannot ensure sufficient strength because both the C content and the N content are low or because the Cr content is high.

Thus, martensitic stainless steel has low stress corrosion crack sensitivity and is inexpensive as compared with austenitic stainless steel, but is inferior in workability. The workability can be improved by subjecting quenched martensitic stainless steel to tempering, i.e. heat treatment at relatively low temperature. In such a case, however, the strength and the corrosion resistance deteriorate due to precipitation of Cr carbide.

It could therefore be helpful to provide a martensitic stainless steel sheet that has both excellent strength and excellent workability and also has excellent corrosion resistance.

Solution to Problem

We conducted study on the strength, workability, and corrosion resistance of martensitic stainless steel sheets and especially on the influences of the C content and the N content on the strength, workability, and corrosion resistance, and discovered the following:

(1) Although C effectively increases strength after quenching, it significantly reduces workability, particularly elongation. On the other hand, although N is slightly inferior to C in the effect of increasing strength, its disadvantage of decreasing elongation is smaller than that of C. It is therefore effective to utilize N in order to enhance strength and elongation in a well-balanced manner.

(2) A martensitic stainless steel sheet having excellent elongation can be obtained while ensuring sufficient strength, by appropriately adjusting the Cr content and the Ni content and, while securing a predetermined total amount of C and N, reducing the C content and increasing the N content, specifically, setting the N content to be not less than the C content.

(3) In the case where the C content is high, corrosion resistance tends to deteriorate due to precipitation of Cr carbide. In the case where the N content is high, Cr nitride precipitates, but the nitride does not deteriorate corrosion resistance as much as the carbide. Hence, limiting the C content and the N content as in (2) can minimize deterioration in corrosion resistance.

We also prepared steel sheets produced with various chemical compositions and production conditions, subjected these steel sheets to bead working assuming actual specifications as gasket parts, and studied cracking of the bead portion. We consequently discovered the following:

(4) By containing an appropriate amount of V in the chemical composition of steel, adjusting the components in response to the containment of V, and performing quenching and tempering under appropriate conditions, coarsening of precipitates formed in the surface layer of the steel sheet can be suppressed to thus effectively prevent cracking of the bead portion.

(5) In detail, as a result of using an appropriate chemical composition containing V and satisfying predetermined production conditions, precipitates formed in the surface layer of the steel sheet are mainly composed of fine Cr and V complex carbonitride instead of coarse Cr carbonitride. Such fine Cr and V complex carbonitride is unlikely to become an origin of cracking of the bead portion in bead working.

Hence, cracking of the bead portion can be effectively prevented by using an appropriate chemical composition containing V and satisfying predetermined production conditions.

The present disclosure is based on these discoveries and further studies.

We thus provide:

1. A martensitic stainless steel sheet comprising a chemical composition containing (consisting of), in mass %, C: 0.035% to 0.090%,
Si: 0.01% to 1.0%,
Mn: 0.01% to 0.90%,
P: 0.050% or less,
S: 0.050% or less,
Cr: 10.0% to 14.0%,
Ni: 0.01% to 0.40%,
Al: 0.001% to 0.50%,
V: 0.05% to 0.50%, and
N: 0.050% to 0.20%, with the balance being Fe and inevitable impurities, wherein a content of C and a content of N in the chemical composition satisfy the following Formulas (1) and (2):

$$C\,\%+N\,\%\geq 0.10\% \quad (1)$$

$$N\,\%\geq C\,\% \quad (2)$$

where C % and N % respectively denote the content of C and the content of N in steel in mass %, the number of precipitates with a major axis length of 200 nm or more in a surface layer of the martensitic stainless steel sheet is 25 or less per 100 $\mu m^2$ (25/100 $\mu m^2$ or less), and the martensitic stainless steel sheet has a tensile strength of 1300 MPa or more, a proof stress of 1100 MPa or more, and an elongation of 8.0% or more.

2. The martensitic stainless steel sheet according to 1., wherein the chemical composition further contains, in mass %, one or more selected from the group consisting of Mo: 0.01% to 0.50%,
Cu: 0.01% to 0.15%, and
Co: 0.01% to 0.50%.

3. The martensitic stainless steel sheet according to 1. or 2., wherein the chemical composition further contains, in mass %, one or more selected from the group consisting of Ti: 0.01% to 0.15%,
Nb: 0.01% to 0.15%, and
Zr: 0.01% to 0.15%.

4. The martensitic stainless steel sheet according to any of 1. to 3., wherein the chemical composition further contains, in mass %, one or more selected from the group consisting of B: 0.0002% to 0.0100%,
Ca: 0.0002% to 0.0100%, and
Mg: 0.0002% to 0.0100%.

Advantageous Effect

It is thus possible to obtain a martensitic stainless steel sheet that has both excellent strength and excellent workability and also has excellent corrosion resistance. Such a martensitic stainless steel sheet is suitable for use in automotive gasket parts.

DETAILED DESCRIPTION

Figure 1A:
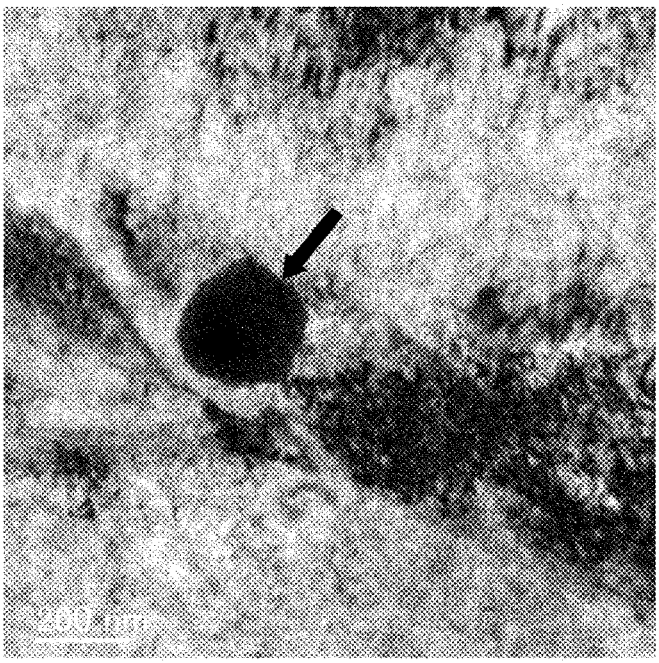
FIG. 1A illustrates an example of a TEM photograph when observing a surface layer of a steel sheet with a transmission electron microscope (TEM) at 5,000 magnifications.

Detailed description will be given below.

The chemical composition of the stainless steel sheet according to the present disclosure will be described first. While the unit of the content of each element in the chemical composition is "mass %", the content is expressed simply in "%" unless otherwise specified.

C: 0.035% to 0.090%

C stabilizes austenite phase at high temperature, and increases the amount of martensite after quenching heat treatment. A larger amount of martensite contributes to higher strength. C also hardens martensite itself, to strengthen the steel. These effects are achieved if the C content is 0.035% or more. If the C content is more than 0.090%, workability tends to deteriorate. Besides, C combines with Cr in the steel and precipitates as carbide. Hence, if C is increased excessively, Cr dissolved in the steel decreases, and the corrosion resistance of the steel deteriorates. Moreover, if the C content is more than 0.090%, coarse Cr carbonitride precipitates and bead workability deteriorates even when an appropriate amount of V described later is contained. The C content is therefore in a range of 0.035% to 0.090%. The C content is preferably 0.040% or more. If the C content is 0.060% or more, workability deteriorates depending on the heat treatment conditions. In view of this, the C content is preferably less than 0.060%. The C content is more preferably less than 0.050%.

Si: 0.01% to 1.0%

Si is an element useful as a deoxidizer. This effect is achieved if the Si content is 0.01% or more. Meanwhile, Si facilitates the formation of ferrite phase at high temperature, and excessively containing Si causes a decrease in the amount of martensite after quenching treatment and makes it impossible to obtain predetermined strength. Besides, Si dissolved in the steel deteriorates the workability of the steel, and facilitates cracking in bead working. The upper limit of the Si content is therefore 1.0%. The Si content is preferably 0.50% or less. The Si content is more preferably 0.45% or less.

Si is an element effective in increasing the strength of the steel. To achieve this effect, the Si content is preferably 0.20% or more. The Si content is more preferably 0.35% or more.

Mn: 0.01% to 0.90%

Mn is an element that has an effect of stabilizing austenite phase at high temperature, and can increase the amount of martensite after quenching heat treatment. Mn also has an effect of increasing the strength of the steel. These effects are achieved if the Mn content is 0.01% or more. If the Mn content is more than 0.90%, the workability of the steel deteriorates, and cracking tends to occur in bead working. The Mn content is therefore in a range of 0.01% to 0.90%. The Mn content is preferably 0.10% or more, and more preferably 0.30% or more. The Mn content is preferably 0.70% or less, and more preferably 0.60% or less.

P: 0.050% or Less

P is an element that deteriorates toughness, and the P content is desirably as low as possible. The P content is therefore 0.050% or less. The P content is preferably 0.040% or less. The P content is more preferably 0.030% or less. No lower limit is placed on the P content, but excessive dephosphorization leads to higher production cost, and thus the lower limit is typically about 0.010%.

S: 0.050% or Less

S is an element that deteriorates formability and corrosion resistance, and the S content is desirably as low as possible. The S content is therefore 0.050% or less. The S content is preferably 0.010% or less. The S content is more preferably 0.005% or less. No lower limit is placed on the S content, but excessive desulfurization leads to higher production cost, and thus the lower limit is typically about 0.001%.

Cr: 10.0% to 14.0%

Cr is an important element to ensure corrosion resistance. To achieve this effect, the Cr content needs to be 10.0% or more. If the Cr content is more than 14.0%, ferrite phase tends to form, as a result of which the amount of martensite after quenching treatment decreases, causing deterioration in tensile strength. The Cr content is therefore in a range of 10.0% to 14.0%. The Cr content is preferably 11.0% or more, and more preferably 12.0% or more. The Cr content is preferably 13.5% or less, and more preferably 13.0% or less.

Ni: 0.01% to 0.40%

Ni is an element that stabilizes austenite phase at high temperature, and has an effect of increasing the amount of martensite after quenching heat treatment. Ni also contributes to higher strength of the steel. These effects are achieved if the Ni content is 0.01% or more. If the Ni content is more than 0.40%, workability deteriorates. The Ni content is therefore in a range of 0.01% to 0.40%. The Ni content is preferably 0.05% or more. The Ni content is preferably 0.30% or less.

Al: 0.001% to 0.50%

Al is an element effective in deoxidation. This effect is achieved if the Al content is 0.001% or more. On the other hand, since Al stabilizes ferrite phase at high temperature, if the Al content is more than 0.50%, the amount of martensite after quenching treatment is insufficient, and desired strength cannot be obtained. The Al content is therefore in a range of 0.001% to 0.50%. The Al content is preferably 0.002% or more, and more preferably 0.003% or more. The Al content is preferably 0.10% or less, and more preferably 0.005% or less.

V: 0.05% to 0.50%

V is an important element to improve bead workability. Without V, C or N dissolved in the steel combines with Cr and precipitates as coarse Cr carbonitride. The size (major axis length) of such Cr carbonitride is about 200 nm to 300 nm, as illustrated in FIG. 1A. Such coarse Cr carbonitride becomes an origin of cracking in bead working, and deteriorates bead workability.

Figure 1B:
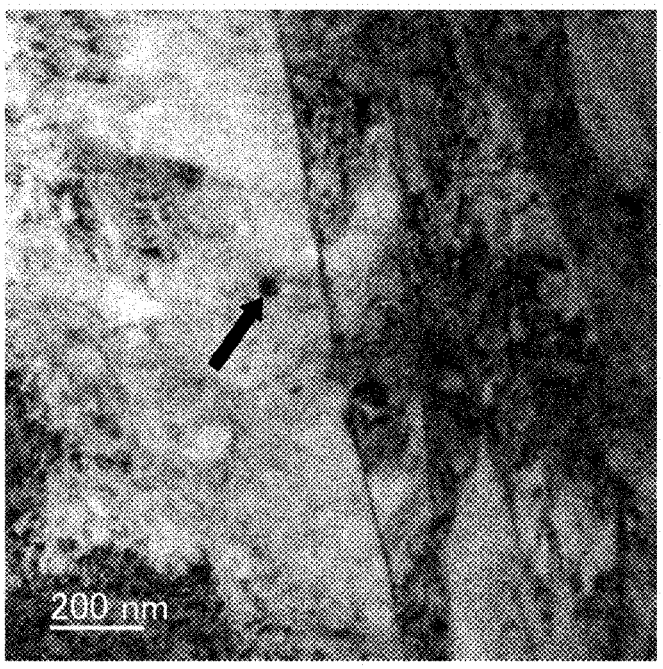
FIG. 1B illustrates an example of a TEM photograph when observing a surface layer of a steel sheet with a transmission electron microscope (TEM) at 5,000 magnifications.

If an appropriate amount of V is contained, precipitates formed in the surface layer of the steel sheet are mainly composed of Cr and V complex carbonitride instead of Cr carbonitride. The size (major axis length) of such Cr and V complex carbonitride is about 100 nm or less, and approximately 40 nm on average, as illustrated in FIG. 1B. Such fine Cr and V complex carbonitride is unlikely to become an origin of cracking in bead working.

V also has an effect of suppressing coarsening of crystal grains in quenching, and improves bead workability through refinement of microstructure.

These effects are achieved if the V content is 0.05% or more. If the V content is more than 0.50%, coarse Cr and V complex carbonitride or V carbonitride mainly composed of V precipitates, and deteriorates bead workability.

The V content is therefore in a range of 0.05% to 0.50%. The V content is preferably 0.10% or more, and more preferably 0.15% or more. The V content is preferably 0.30% or less, and more preferably 0.25% or less.

FIGS. 1A and 1B each illustrate an example of a TEM photograph when observing a surface layer of a steel sheet with a transmission electron microscope (TEM) at 5,000 magnifications.

N: 0.050% to 0.20%

N is an important element that can significantly increase the strength of the martensitic stainless steel, as with C. N also increases the martensite content after quenching heat treatment by stabilizing austenite phase at a high temperature, and highly strengthens the steel by hardening the martensite itself. These effects are achieved if the N content is 0.050% or more. If the N content is more than 0.20%, workability and corrosion resistance deteriorate. Besides, if the N content is more than 0.20%, coarse Cr carbonitride precipitates and bead workability deteriorates even when the appropriate amount of V is contained. The N content is therefore in a range of 0.050% to 0.20%. The N content is preferably 0.070% or more. The N content is preferably 0.15% or less, and more preferably 0.13% or less.

By performing tempering heat treatment after quenching in the case where the N content is 0.080% or more, N precipitates as finer nitride in tempering treatment, with it being possible to increase strength without decreasing elongation. In view of this, the N content is further preferably 0.080% or more.

It is very important that the stainless steel sheet according to the present disclosure has the above-described chemical composition, in particular has the C content and the N content in the above-described ranges, and the C content and the N content satisfy both of the following Formulas (1) and (2):

$$C\ \%+N\ \% \geq 0.10\% \quad (1)$$

$$N\ \% \geq C\ \% \quad (2)$$

where C % and N % respectively denote the C content and the N content in the steel (mass %).

An experiment that led to the idea of adjusting the C content and the N content to the above-described ranges and satisfying the foregoing Formulas (1) and (2) in the martensitic stainless steel sheet according to the present disclosure will be described below.

(Experiment 1)

Steel ingots of 30 kg having chemical compositions containing, in mass %, Si: 0.01% to 1.0%, Mn: 0.01% to 0.90%, P: 0.050% or less, S: 0.050% or less, Cr: 10.0% to 14.0%, Ni: 0.01% to 0.40%, Al: 0.001% or more and 0.50% or less, and V: 0.10% to 0.50% with various C contents and N contents (the balance being Fe and inevitable impurities) were each melted and cast in a vacuum melting furnace, heated to 1170° C., and then hot rolled to obtain a sheet bar with a thickness of 25 mm and a width of 150 mm. The sheet bar was held in a furnace of 700° C. for 10 hr to be softened. After this, the sheet bar was heated to 1100° C., and hot rolled to obtain a hot-rolled sheet with a sheet thickness of 4 mm. Subsequently, the hot-rolled sheet was annealed by holding it in a furnace of 700° C. for 10 hr, to obtain a hot-rolled and annealed sheet. The hot-rolled and annealed sheet was then cold rolled to obtain a cold-rolled sheet with a sheet thickness of 0.2 mm. The cold-rolled sheet was subjected to quenching treatment of heating to a temperature of 1000° C. to 1100° C., holding for 30 sec, and cooling. The cooling rate in the quenching treatment was 1° C./sec or more for all samples. After the quenching treatment, the cold-rolled sheet was subjected to tempering treatment of heating to a temperature of 200° C. to 400° C. and holding for 30 sec.

A JIS No. 5 tensile test piece of which longitudinal direction is the rolling direction was obtained from the cold-rolled martensitic stainless steel sheet (quenched-and-tempered steel material) produced in the above-described way, and subjected to a tensile test at room temperature to measure the tensile strength (T.S.) and the elongation (EL). The original gauge length was 50 mm, and the tension rate was 10 mm/min. The test was conducted two times for each steel, and the evaluation was made based on the average value. Regarding the elongation (EL), two fractured test pieces were butted together with their axes being on a straight line, the final gauge length was measured, and EL was calculated according to the following Formula:

$$EL(\%)=(L_u-L_0)/L_0\times 100$$

where EL is the elongation (elongation after fracture), $L_0$ is the original gauge length, and $L_u$ is the final gauge length.

Figure 2:
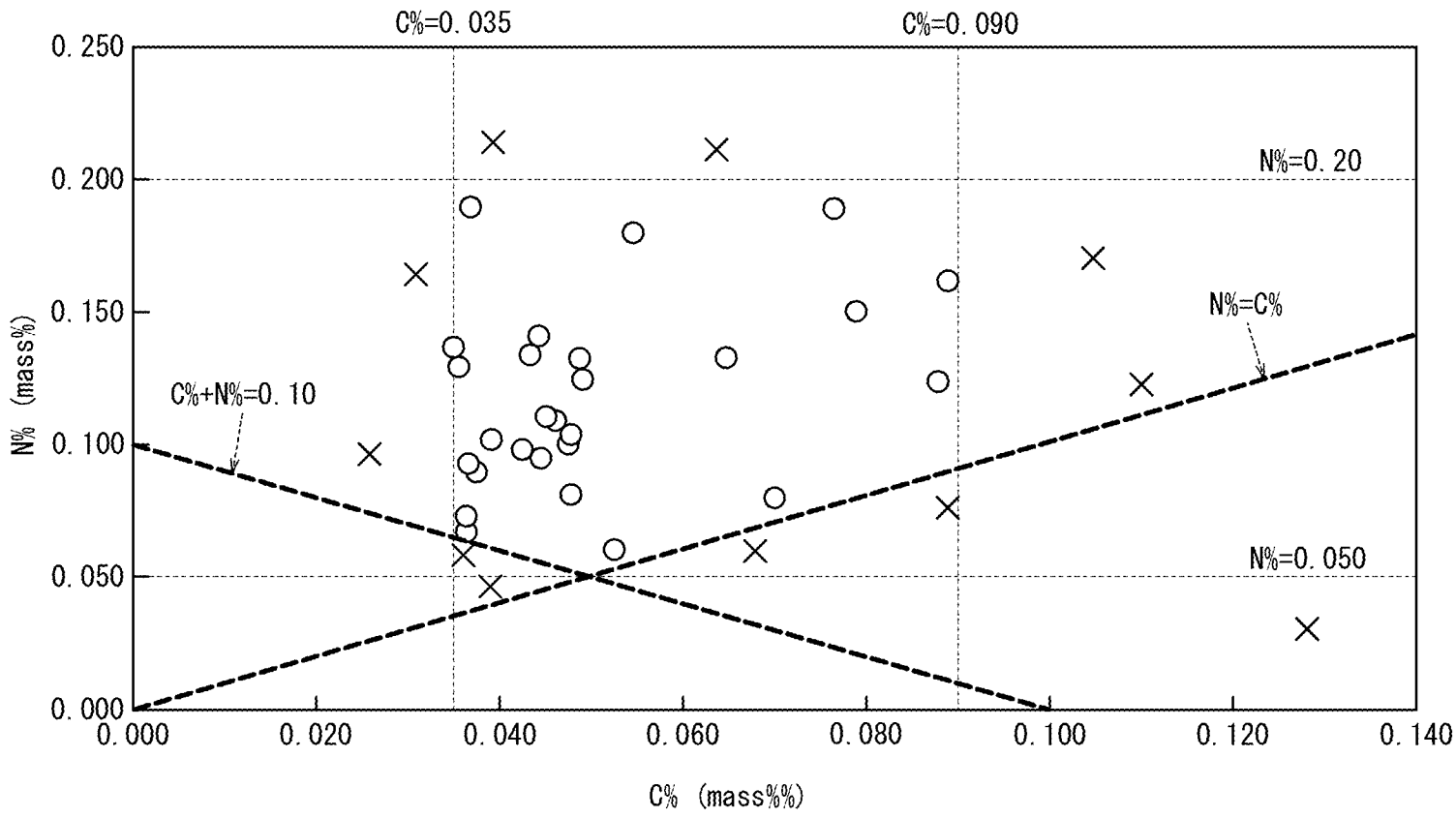
FIG. 2 is a graph plotting the evaluation results of the tensile strengths and elongations of steel sheets having various chemical compositions against C content and N content.

FIG. 2 illustrates the evaluation results plotted against the C content and the N content. In FIG. 2, the circle mark (good) and the cross mark (poor) have the following meanings:

circle: tensile strength (T.S.)≥1300 MPa and elongation (EL)≥8.0% cross: tensile strength (T.S.)<1300 MPa and/or elongation (EL)<8.0%.

As illustrated in FIG. 2, excellent elongation was obtained while ensuring sufficient strength by adjusting the C content and the N content respectively to a range of 0.035% to 0.090% and a range of 0.050% to 0.20% and satisfying the foregoing Formulas (1) and (2). In the case where the C content and/or the N content was outside its predetermined range, sufficient strength and/or elongation was not obtained even when the foregoing Formulas (1) and (2) were satisfied.

Thus, the martensitic stainless steel sheet according to the present disclosure has the C content and the N content that are respectively in the above-described ranges and satisfy the foregoing Formulas (1) and (2).

As mentioned above, C and N are both elements effective in strengthening the martensitic stainless steel. Accordingly, the strength of the martensitic stainless steel varies with the total content of C and N. To achieve intended strength in the present disclosure, the total content of C and N needs to be 0.10% or more. If the total content of C and N is less than 0.10%, desired strength cannot be achieved. Meanwhile, since an increase of the C content leads to lower workability, C needs to be reduced as much as possible. Hence, it is necessary to increase the content of N capable of strengthening the steel with little deterioration in workability, relative to C. Excellent strength and excellent workability can both be achieved in this way.

As illustrated in FIG. 2, a stainless steel sheet having both excellent strength and excellent workability cannot be obtained unless the foregoing Formulas (1) and (2) are satisfied while the C content and the N content are adjusted respectively to a range of 0.035% to 0.090% and a range of 0.050% to 0.20%. In particular, in the case where N %<C %, C excessively strengthens the steel and causes deterioration in workability, so that N cannot exhibit its effect of strengthening the steel without deteriorating workability. In the case where N %≥C %, on the other hand, N is a strength-elongation controlling factor, and thus the effect of strengthening the steel without deteriorating workability can be achieved. In the case where N %<C %, carbide precipitates preferentially during cooling in quenching treatment or during tempering treatment, causing deterioration in corrosion resistance. In the case where N %≥C %, on the other hand, nitride precipitates preferentially over carbide. Since the nitride has less harmful effect on the corrosion resistance of the steel than the carbide, deterioration in corrosion resistance can be prevented.

Thus, maximum use of the effects of N need to be made in order to obtain steel excellent in all of strength, workability (elongation), and corrosion resistance. To do so, it is essential to adjust the C content and the N content respectively to a range of 0.035% to 0.090% and a range of 0.050% to 0.20% and also satisfy the foregoing Formulas (1) and (2).

Regarding the foregoing Formula (1), C %+N % 0.12% is preferable, and C %+N %≥0.14% is further preferable.

Regarding the foregoing Formula (2), N %≥1.05×C % is preferable, and N %≥1.16×C % is further preferable. If N %>5×C %, coarse nitride tends to form, causing deterioration in both strength and corrosion resistance. It is therefore preferable that N %≥5×C %.

While the basic components have been described above, the stainless steel sheet according to the present disclosure may optionally contain one or more selected from the group consisting of Mo, Cu, and Co, one or more selected from the group consisting of Ti, Nb, and Zr, and one or more selected from the group consisting of B, Ca, and Mg in the following ranges.

Mo: 0.01% to 0.50%

Mo is an element that increases the strength of the steel by solid solution strengthening. This effect is achieved if the Mo content is 0.01% or more. However, Mo is an expensive element. Besides, if the Mo content is more than 0.50%, the workability of the steel deteriorates. Accordingly, in the case of containing Mo, the Mo content is in a range of 0.01% to 0.50%. The Mo content is preferably 0.02% or more, and more preferably 0.03% or more. The Mo content is preferably 0.25% or less, and more preferably 0.10% or less.

Cu: 0.01% to 0.15%

Cu finely precipitates into the steel and strengthens the steel during cooling in quenching treatment. This effect is achieved if the Cu content is 0.01% or more. If the Cu content is more than 0.15%, the amount of Cu precipitate increases, which facilitates cracking in bead working. Accordingly, in the case of containing Cu, the Cu content is in a range of 0.01% to 0.15%. The Cu content is preferably 0.02% or more, and more preferably 0.03% or more. The Cu content is preferably 0.10% or less, and more preferably 0.06% or less.

Co: 0.01% to 0.50%

Co is an element that has an effect of improving the toughness of the steel and also reducing the thermal expansion coefficient of the steel. This effect is achieved if the Co content is 0.01% or more. A gasket part may be, after being worked into shape, coated with rubber or the like and put to use. During such coating, the gasket part is heated to 100° C. to 300° C. Here, if the thermal expansion coefficient is high, the shape of the part changes. The thermal expansion coefficient is therefore preferably low in terms of shape stability. Co is, however, an expensive element. Besides, if the Co content is more than 0.50%, not only the above-described effect is saturated, but also workability deteriorates. Accordingly, in the case of containing Co, the Co content is in a range of 0.01% to 0.50%. The Co content is preferably 0.02% or more, and more preferably 0.03% or more. The Co content is preferably 0.25% or less, and more preferably 0.10% or less.

Ti: 0.01% to 0.15%

Ti has an effect of, by combining with C and precipitating as carbide or combining with N and precipitating as nitride, suppressing the formation of Cr carbide or Cr nitride during cooling in quenching treatment and improving the corrosion resistance of the steel. This effect is achieved if the Ti content is 0.01% or more. If the Ti content is more than 0.15%, a large amount of Ti carbide precipitates and C dissolved in the steel decreases, and the strength of martensite phase deteriorates. Accordingly, in the case of containing Ti, the Ti content is in a range of 0.01% to 0.15%. The Ti content is preferably 0.02% or more. The Ti content is preferably 0.10% or less.

Nb: 0.01% to 0.15%

Nb has an effect of improving strength and workability by refining the crystal grain size. This effect is achieved if the Nb content is 0.01% or more. Nb also has an effect of improving corrosion resistance by suppressing the precipitation of Cr carbide to prevent a decrease of Cr in the steel. If the Nb content is more than 0.15%, a large amount of Nb carbide precipitates and C dissolved in the steel decreases, and the strength of martensite phase deteriorates. Accordingly, in the case of containing Nb, the Nb content is in a range of 0.01% to 0.15%. The Nb content is preferably 0.02% or more, and more preferably 0.03% or more. The Nb content is preferably 0.10% or less, and more preferably 0.05% or less.

Zr: 0.01% to 0.15%

Zr has an effect of, by combining with C and precipitating as carbide or combining with N and precipitating as nitride, suppressing the formation of Cr carbide or Cr nitride and improving the corrosion resistance of the steel. Zr also has an effect of strengthening the steel. These effects are achieved if the Zr content is 0.01% or more. If the Zr content is more than 0.15%, a large amount of Zr carbide precipitates and C dissolved in the steel decreases, and the strength of martensite phase deteriorates. Accordingly, in the case of containing Zr, the Zr content is in a range of 0.01% to 0.15%. The Zr content is preferably 0.02% or more. The Zr content is preferably 0.10% or less.

B: 0.0002% to 0.0100%

B is an element effective in improving workability. This effect is achieved if the B content is 0.0002% or more. If the B content is more than 0.0100%, the workability and toughness of the steel deteriorate. Moreover, B combines with N in the steel and precipitates as nitride, as a result of which the amount of martensite decreases and the strength of the steel deteriorates. Accordingly, in the case of containing B, the B content is in a range of 0.0002% to 0.0100%. The B content is preferably 0.0005% or more, and more preferably 0.0010% or more. The B content is preferably 0.0050% or less, and more preferably 0.0030% or less.

Ca: 0.0002% to 0.0100%

Ca is a component effective in preventing a nozzle blockage caused by precipitation of inclusions which tends to occur in continuous casting. This effect is achieved if the Ca content is 0.0002% or more. If the Ca content is more than 0.0100%, surface defects occur. Accordingly, in the case of containing Ca, the Ca content is in a range of 0.0002% to 0.0100%. The Ca content is preferably 0.0002% or more, and more preferably 0.0005% or more. The Ca content is preferably 0.0030% or less, and more preferably 0.0020% or less.

Mg: 0.0002% to 0.0100%

Mg is an element effective in suppressing coarsening of carbonitride. If carbonitride precipitates coarsely, such carbonitride becomes an origin of brittle cracking, as a result of which toughness deteriorates. This toughness improving effect is achieved if the Mg content is 0.0002% or more. If the Mg content is more than 0.0100%, the surface characteristics of the steel degrade. Accordingly, in the case of containing Mg, the Mg content is in a range of 0.0002% to 0.0100%. The Mg content is preferably 0.0002% or more, and more preferably 0.0005% or more. The Mg content is preferably 0.0030% or less, and more preferably 0.0020% or less.

The components other than those described above are Fe and inevitable impurities.

Thus, the martensitic stainless steel sheet according to the present disclosure has a chemical composition containing, in mass %, C: 0.035% to 0.090%, Si: 0.01% to 1.0%, Mn: 0.01% to 0.90%, P: 0.050% or less, S: 0.050% or less, Cr: 10.0% to 14.0%, Ni: 0.01% to 0.40%, Al: 0.001% to 0.50%, V: 0.05% to 0.50%, and N: 0.050% to 0.20% where the C content and the N content satisfy the foregoing Formulas (1) and (2), optionally further containing one or more selected from the group consisting of Mo: 0.01% to 0.50%, Cu: 0.01% to 0.15%, Co: 0.01% to 0.50%, Ti: 0.01% to 0.15%, Nb: 0.01% to 0.15%, Zr: 0.01% to 0.15%, B: 0.0002% to 0.0100%, Ca: 0.0002% to 0.0100%, and Mg: 0.0002% to 0.0100%, with the balance being Fe and inevitable impurities.

The microstructure of the martensitic stainless steel sheet according to the present disclosure will be described below.

The microstructure of the martensitic stainless steel sheet according to the present disclosure is mainly composed of martensite phase to obtain high-strength steel material having a tensile strength of 1300 MPa or more and a proof stress of 1100 MPa or more. Specifically, the microstructure of the martensitic stainless steel sheet includes martensite phase of 80% or more in volume fraction with respect to the whole microstructure, and ferrite phase and/or retained austenite phase as residual microstructures. The volume fraction of martensite phase is preferably 90% or more and martensite single phase is allowable of course. The volume fraction of each of ferrite phase and retained austenite is preferably 5% or less.

The volume fraction of martensite phase can be determined by obtaining a test piece for cross-sectional observation from a final cold-rolled sheet after quenching or tempering, etching the test piece with aqua regia, observing the test piece using an optical microscope for 10 observation fields at 500 magnifications, distinguishing martensite phase from ferrite phase and retained austenite phase based on the microstructure shape and the etching strength, and then finding the volume fraction of martensite phase by image processing and averaging the volume fraction.

It is also very important to limit the number of precipitates with major axis length of 200 nm or more in the surface layer of the martensitic stainless steel sheet according to the present disclosure to 25 or less per 100 $\mu m^2$.

Number of precipitates with major axis length of 200 nm or more in surface layer of steel sheet: 25 or less per 100 $\mu m^2$ Coarse precipitates, specifically, precipitates with major axis length of 200 nm or more, in the surface layer of the steel sheet tend to become origins of cracking of the bead portion in bead working. In terms of bead workability, it is very important to reduce the number of such coarse precipitates.

If the number of precipitates with a major axis length of 200 nm or more in the surface layer of the steel sheet is more than 25 per 100 $\mu m^2$, cracking tends to occur in bead working. Accordingly, the number of precipitates with a major axis length of 200 nm or more in the surface layer of the steel sheet is limited to 25 or less per 100 $\mu m^2$. The number of precipitates with a major axis length of 200 nm or more in the surface layer of the steel sheet is preferably 15 or less per 100 $\mu m^2$. No lower limit is placed on the number of precipitates with a major axis length of 200 nm or more, and the lower limit may be 0.

Herein, the "surface layer of the steel sheet" denotes the range from the surface of the steel sheet to a depth of 0.05 mm in the sheet thickness direction. The "major axis length" denotes the length of the longest diameter when a precipitate is seen in the sheet thickness direction.

The "precipitates" denote, for example, Cr and V complex carbonitride, Cr carbonitride, and V carbonitride. The term "carbonitride" encompasses carbide, nitride, and a complex of carbide and nitride.

Fine precipitates with a major axis length of less than 200 nm are unlikely to become origins of cracking in bead working, and thus do not adversely affect bead workability.

Furthermore, the martensitic stainless steel sheet according to the present disclosure has a tensile strength of 1300 MPa or more, a proof stress of 1100 MPa or more, and an elongation of 8.0% or more.

Tensile Strength: 1300 MPa or More

To suppress fractures when repeatedly compressing the bead portion of the gasket, the tensile strength needs to be 1300 MPa or more. If the tensile strength is less than 1300 MPa, the bead portion easily cracks during use.

No upper limit is placed on the tensile strength, but the tensile strength is desirably 1800 MPa or less in terms of performing bead working.

Proof Stress: 1100 MPa or More

The proof stress influences the bead height recovered after the bead portion is compressed. If the proof stress is less than 1100 MPa, the recovered height of the bead portion is insufficient, and a gap may form during use. The proof stress herein is 0.2% proof stress.

No upper limit is placed on the proof stress, but the proof stress is desirably 1500 MPa or less in terms of performing bead working.

Elongation: 8.0% or More

If the elongation is insufficient, cracking may occur in bead working. The elongation therefore needs to be 8.0% or more.

No upper limit is placed on the elongation, but the upper limit is typically about 15.0%.

A preferred method of producing the martensitic stainless steel sheet according to the present disclosure will be described below.

The martensitic stainless steel sheet according to the present disclosure is preferably produced by: hot rolling a steel raw material having the above-described chemical composition to obtain a hot-rolled sheet; hot band annealing and pickling the hot-rolled sheet to obtain a hot-rolled and annealed sheet; cold rolling the hot-rolled and annealed sheet to obtain a cold-rolled sheet; further subjecting the cold-rolled sheet to quenching treatment of heating to a temperature of 950° C. or more and 1100° C. or less, holding for 5 sec to 600 sec, and cooling; and thereafter subjecting the cold-rolled sheet to tempering treatment of heating to a temperature of 200° C. or more and 400° C. or less and holding for 5 sec to 600 sec.

In detail, the martensitic stainless steel sheet according to the present disclosure can be produced by the following method: Steel having the above-described chemical composition is melted in a melting furnace such as a converter or an electric heating furnace, subjected to secondary refining such as ladle refining or vacuum refining, and then formed into a steel raw material (e.g. a slab or a sheet bar) by continuous casting or ingot casting-blooming. The steel raw material is subjected to hot rolling, hot band annealing, and optional pickling, to obtain a hot-rolled and annealed sheet. The hot-rolled and annealed sheet is then subjected to processes such as cold rolling, quenching treatment, optional pickling, and tempering treatment, to obtain a cold-rolled sheet.

For example, molten steel is prepared by steelmaking in a converter, an electric heating furnace, or the like, and subjected to secondary refining by VOD method or AOD method to have the above-described chemical composition. The molten steel is then formed into a slab by continuous casting. At this time, in order to decrease the C content and increase the N content and to keep the N content equal to or more than the C content, nitrogen-containing raw materials such as chromium nitride are added or nitrogen gas is blown, if necessary, to keep the N content at a predetermined value.

The slab is heated to a temperature of 1000° C. to 1250° C., and hot rolled to obtain a hot-rolled sheet with a desired sheet thickness. The hot-rolled sheet is subjected to batch annealing in a temperature range of 600° C. to 800° C., and then shot blasted and pickled to remove oxide scale, thus obtaining a hot-rolled and annealed sheet. The hot-rolled and annealed sheet is further cold rolled, and subjected to quenching treatment, to obtain a cold-rolled sheet. In the cold rolling, the hot-rolled and annealed sheet may be cold rolled twice or more with intermediate annealing being performed therebetween according to need. The total rolling reduction in the whole cold rolling process composed of one or more cold rolling operations is 60% or more, and preferably 80% or more.

In the quenching treatment, the cold-rolled sheet is preferably heated to a temperature of 950° C. or more and 1100° C. or less, held for 5 sec to 600 sec, and cooled, in terms of achieving desired properties (strength, elongation).

If the temperature of the quenching treatment is higher than this range, crystal grains (in particular prior austenite grains) may coarsen, causing deterioration in bead workability. If the temperature of the quenching treatment is lower than this range, a large amount of ferrite may form, causing the amount of martensite to be insufficient and making it impossible to achieve desired strength and proof stress. The temperature of the quenching treatment is more preferably 1000° C. or more. The temperature of the quenching treatment is more preferably 1050° C. or less.

If the holding time is less than 5 sec, coarse Cr carbonitride may precipitate instead of Cr and V complex carbonitride. The holding time is more preferably 20 sec or more. If the holding time is more than 600 sec, crystal grains and in particular prior austenite grains may coarsen, causing deterioration in bead workability.

The cooling rate in the quenching treatment is preferably 1° C./sec or more in order to achieve desired strength.

After the quenching treatment, tempering treatment needs to be performed. Excellent workability cannot be achieved without the tempering treatment. In the tempering treatment, the cold-rolled and quenched sheet is preferably heated to a temperature of 200° C. or more and 400° C. or less and held for 5 sec to 600 sec, in terms of achieving desired properties.

If the temperature of the tempering treatment is higher than this range, martensite may be tempered, causing not only deterioration in strength and proof stress but also deterioration in corrosion resistance. If the temperature of the tempering treatment is lower than this range, martensite may be unstable, making it impossible to achieve excellent workability (elongation, bead workability). The temperature of the tempering treatment is more preferably 250° C. or more. The temperature of the tempering treatment is more preferably 350° C. or less.

If the holding time is less than 5 sec, martensite may be unstable, making it impossible to achieve excellent workability (elongation, bead workability). The holding time is more preferably 20 sec or more. If the holding time is more than 600 sec, martensite may be tempered, causing not only deterioration in strength and proof stress but also deterioration in corrosion resistance.

Each of the quenching treatment and the tempering treatment may be followed by pickling. Alternatively, each of the quenching treatment and the tempering treatment may be performed in a reducing atmosphere containing hydrogen to obtain a bright annealed (BA) finish without pickling.

The cold-rolled sheet product obtained in this way is subjected to bending, bead working, perforation, or the like depending on the use, and formed into, for example, a gasket part used as a seal material between an engine and an exhaust system part of a vehicle. The cold-rolled sheet product may also be used as a member required to have spring property. The part formed from the cold-rolled sheet may be optionally subjected to quenching treatment.

Examples

Steel ingots of 30 kg having the chemical compositions shown in Table 1 (the balance being Fe and inevitable impurities) were each melted and cast in a vacuum melting furnace, heated to 1200° C., and then hot rolled to obtain a sheet bar with a thickness of 25 mm and a width of 150 mm. The sheet bar was held in a furnace of 700° C. for 10 hr to be softened. After this, the sheet bar was heated to 1100° C., and hot rolled to obtain a hot-rolled sheet with a sheet thickness of 4 mm. Subsequently, the hot-rolled sheet was annealed by holding it in a furnace of 700° C. for 10 hr, to obtain a hot-rolled and annealed sheet. The hot-rolled and annealed sheet was then cold rolled to obtain a cold-rolled sheet with a sheet thickness of 0.2 mm. The cold-rolled sheet was subjected to quenching treatment with the quenching temperature and the quenching holding time shown in Table 2. The cooling rate in the quenching treatment was 1° C./sec or more for all samples. After the quenching treatment, the cold-rolled sheet was subjected to tempering treatment with the tempering temperature and the tempering holding time shown in Table 2. The holding time in each of the quenching treatment and the tempering treatment is the residence time in a temperature range of the heating temperature ±10° C. In steels No. 2 and No. 36 to 39, the same cold-rolled sheets were subjected to the subsequent quenching treatment and tempering treatment. In steels No. 8 and No. 40, the same cold-rolled sheets were subjected to the subsequent quenching treatment and tempering treatment.

<Microstructure Observation>

A test piece for cross-sectional observation was obtained from each cold-rolled martensitic stainless steel sheet (quenched-and-tempered steel material) produced in the above-described way, etched with aqua regia, and observed using an optical microscope for 10 observation fields at 500 magnifications. After distinguishing martensite phase from ferrite phase based on the microstructure shape and the etching strength, the volume fraction of martensite phase was determined by image processing and averaged.

The observation results are shown in Table 2. Regarding the amount of martensite in Table 2, "excellent" indicates that the volume fraction of martensite phase with respect to the whole microstructure was 90% or more and 100% or less, "good" indicates that the volume fraction of martensite phase with respect to the whole microstructure was 80% or more and less than 90%, and "poor" indicates that the volume fraction of martensite phase with respect to the whole microstructure was less than 80%.

<Precipitate Observation>

A small piece with a width of 15 mm and a length of 15 mm was cut out of each cold-rolled martensitic stainless steel sheet (quenched-and-tempered steel material) produced in the above-described way, and reduced in thickness to 0.05 mm by polishing from one side. Its surface was then observed using a transmission electron microscope (TEM), and the number of precipitates with a major axis length of 200 nm or more was measured. The observation was performed for 10 observation fields at 5,000 magnifications.

The observation results are shown in Table 2. Regarding the number of precipitates in Table 2, "excellent" indicates that the number of precipitates with a major axis length of 200 nm or more was 15 or less per 100 $\mu m^2$, "good" indicates that the number of precipitates with a major axis length of 200 nm or more was more than 15 per 100 $\mu m^2$ and 25 or less per 100 $\mu m^2$, and "poor" indicates that the number of precipitates with a major axis length of 200 nm or more was more than 25 per 100 $\mu m^2$.

<Tensile Test>

A JIS No. 5 tensile test piece of which longitudinal direction is the rolling direction was obtained from each cold-rolled martensitic stainless steel sheet (quenched-and-tempered steel material) produced in the above-described way, and subjected to a tensile test at room temperature according to JIS Z2241, to measure the tensile strength (T.S.), the proof stress (P.S.), and the elongation (EL). The original gauge length was 50 mm, and the tension rate was 10 mm/min. The test was conducted two times for each steel, and the evaluation was made based on the average value.

Regarding the elongation (EL), two fractured test pieces were butted together with their axes being on a straight line, the final gauge length was measured, and EL was calculated according to the following Formula:

$$EL(\%)=(L_u-L_0)/L_0\times 100$$

where EL is the elongation (elongation after fracture), $L_0$ is the original gauge length, and $L_u$ is the final gauge length.

The evaluation results are shown in Table 2. The evaluation criteria are as follows:

Tensile strength (T.S.)
good: 1300 MPa or more
poor: less than 1300 MPa
Proof stress (P.S.)
good: 1100 MPa or more
poor: less than 1100 MPa
Elongation (EL)
good: 8.0% or more
poor: less than 8.0%.

<Bead Workability Evaluation Test>

Figure 3A:
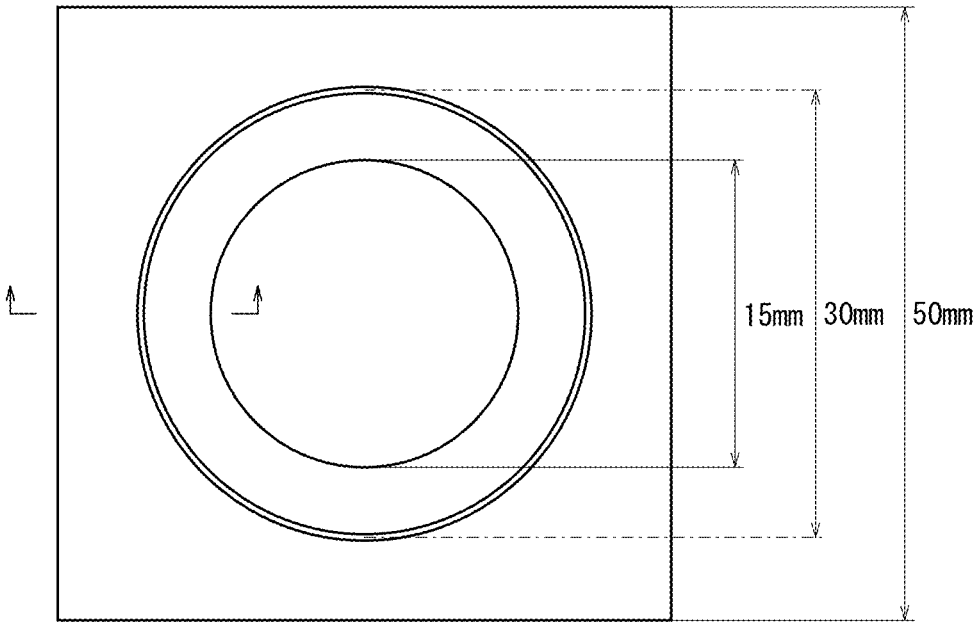
FIG. 3A is a schematic diagram illustrating a bead shape after bead working performed to evaluate bead workability in examples.
Figure 3B:
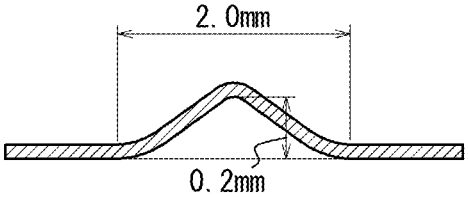
FIG. 3B is a schematic diagram illustrating a bead shape after bead working performed to evaluate bead workability in examples.

A test piece with a width of 60 mm and a length of 60 mm was cut out of each cold-rolled martensitic stainless steel sheet (quenched-and-tempered steel material) produced in the above-described way, and press worked to form a bead of the shape illustrated in FIGS. 3A and 3B. The bead top and foot after the working were observed using a magnifier, and the bead workability was evaluated based on the following criteria. The evaluation results are shown in Table 2. Herein, shrinkage means a narrow (about 0.1 mm) depression.

excellent: no cracking and no shrinkage
good: shrinkage, but no cracking
poor: cracking.

<Corrosion Resistance Evaluation Test>

A test piece with a width of 60 mm and a length of 80 mm was cut out of each cold-rolled martensitic stainless steel sheet (quenched-and-tempered steel material) produced in the above-described way, and subjected to a corrosion resistance evaluation test according to Japanese Automotive Standards Organization: Corrosion Test Method for Automotive Materials (JASO M 609-91). The surface of the test piece was polished with No. 600 emery paper. The entire back surface and 5 mm around the surface were covered with a seal. In the test, 5% salt spray (2 hr)-60° C. dry (4 hr)-50° C. wet (2 hr) constituted 1 cycle, and the corrosion area ratio of the front surface was measured after 15 cycles. The test was conducted two times for each steel, and the one with the higher corrosion area ratio was used for the evaluation of the cold-rolled sheet.

The evaluation results are shown in Table 2. The evaluation criteria are as follows:

good: corrosion area ratio of less than 30%
poor: corrosion area ratio of 30% or more.

TABLE 1

| Steel | Chemical composition (mass %) | | | | | | | | | | | C % + | N %/ | |
|---|---|---|---|---|---|---|---|---|---|---|---|---|---|---|
| No. | C | Si | Mn | P | S | Cr | Ni | Al | V | N | Others | N % | C % | Remarks |
| 1 | 0.048 | 0.83 | 0.43 | 0.036 | 0.002 | 13.4 | 0.11 | 0.002 | 0.34 | 0.081 | — | 0.129 | 1.69 | Example |
| 2 | 0.045 | 0.30 | 0.32 | 0.034 | 0.001 | 12.5 | 0.16 | 0.005 | 0.18 | 0.111 | — | 0.156 | 2.47 | Example |
| 3 | 0.035 | 0.40 | 0.82 | 0.025 | 0.002 | 12.0 | 0.19 | 0.002 | 0.13 | 0.136 | — | 0.171 | 3.89 | Example |
| 4 | 0.036 | 0.42 | 0.30 | 0.036 | 0.003 | 13.0 | 0.37 | 0.003 | 0.34 | 0.072 | — | 0.108 | 2.00 | Example |
| 5 | 0.044 | 0.50 | 0.48 | 0.025 | 0.002 | 13.1 | 0.16 | 0.290 | 0.23 | 0.139 | — | 0.183 | 3.16 | Example |
| 6 | 0.037 | 0.41 | 0.27 | 0.035 | 0.002 | 12.7 | 0.08 | 0.003 | 0.25 | 0.092 | — | 0.129 | 2.49 | Example |
| 7 | 0.037 | 0.31 | 0.45 | 0.022 | 0.002 | 12.5 | 0.09 | 0.002 | 0.07 | 0.067 | — | 0.104 | 1.81 | Example |
| 8 | 0.037 | 0.42 | 0.30 | 0.036 | 0.003 | 10.9 | 0.18 | 0.004 | 0.38 | 0.189 | — | 0.226 | 5.11 | Example |
| 9 | 0.088 | 0.40 | 0.39 | 0.028 | 0.002 | 11.8 | 0.14 | 0.005 | 0.32 | 0.123 | — | 0.211 | 1.40 | Example |
| 10 | 0.048 | 0.33 | 0.42 | 0.025 | 0.001 | 12.6 | 0.11 | 0.002 | 0.19 | 0.103 | Cu: 0.08 | 0.151 | 2.15 | Example |
| 11 | 0.038 | 0.48 | 0.22 | 0.025 | 0.003 | 12.5 | 0.14 | 0.004 | 0.21 | 0.090 | Mo: 0.24 | 0.128 | 2.37 | Example |
| 12 | 0.044 | 0.33 | 0.36 | 0.028 | 0.002 | 11.5 | 0.09 | 0.002 | 0.30 | 0.133 | Co: 0.03 | 0.177 | 3.02 | Example |
| 13 | 0.047 | 0.45 | 0.21 | 0.024 | 0.001 | 13.4 | 0.05 | 0.004 | 0.22 | 0.109 | Ti: 0.04 | 0.156 | 2.32 | Example |
| 14 | 0.047 | 0.43 | 0.21 | 0.030 | 0.002 | 13.1 | 0.18 | 0.003 | 0.33 | 0.100 | Nb: 0.03 | 0.147 | 2.13 | Example |
| 15 | 0.049 | 0.45 | 0.42 | 0.026 | 0.002 | 13.7 | 0.17 | 0.005 | 0.35 | 0.131 | Zr: 0.06 | 0.180 | 2.67 | Example |
| 16 | 0.036 | 0.45 | 0.44 | 0.029 | 0.001 | 12.6 | 0.15 | 0.003 | 0.11 | 0.128 | B: 0.0013 | 0.164 | 3.56 | Example |
| 17 | 0.043 | 0.40 | 0.25 | 0.036 | 0.002 | 12.0 | 0.14 | 0.005 | 0.26 | 0.097 | Mg: 0.0011 | 0.140 | 2.26 | Example |
| 18 | 0.040 | 0.41 | 0.42 | 0.037 | 0.003 | 11.0 | 0.08 | 0.001 | 0.42 | 0.101 | Ca: 0.0012 | 0.141 | 2.53 | Example |
| 19 | 0.049 | 0.26 | 0.40 | 0.024 | 0.002 | 13.2 | 0.17 | 0.002 | 0.25 | 0.124 | Cu: 0.04, Nb: 0.05, B: 0.0009 | 0.173 | 2.53 | Example |
| 20 | 0.045 | 0.37 | 0.40 | 0.037 | 0.002 | 12.9 | 0.18 | 0.002 | 0.32 | 0.095 | Cu: 0.05, Mg: 0.0009, Ca: 0.0010 | 0.140 | 2.11 | Example |
| 21 | 0.128 | 0.35 | 0.46 | 0.020 | 0.004 | 12.7 | 0.07 | 0.003 | — | 0.031 | — | 0.159 | 0.24 | Comparative Example |
| 22 | 0.026 | 0.36 | 0.42 | 0.031 | 0.002 | 13.7 | 0.10 | 0.004 | 0.32 | 0.096 | — | 0.122 | 3.69 | Comparative Example |
| 23 | 0.110 | 0.35 | 0.22 | 0.021 | 0.002 | 13.6 | 0.07 | 0.001 | 0.33 | 0.123 | — | 0.233 | 1.12 | Comparative Example |

TABLE 1-continued

| Steel No. | Chemical composition (mass %) C | Si | Mn | P | S | Cr | Ni | Al | V | N | Others | C % + N % | N %/ C % | Remarks |
|---|---|---|---|---|---|---|---|---|---|---|---|---|---|---|
| 24 | 0.035 | 1.08 | 0.48 | 0.024 | 0.002 | 12.5 | 0.07 | 0.005 | 0.49 | 0.074 | — | 0.109 | 2.11 | Comparative Example |
| 25 | 0.045 | 0.41 | 1.05 | 0.024 | 0.001 | 12.8 | 0.20 | 0.001 | 0.42 | 0.074 | — | 0.119 | 1.64 | Comparative Example |
| 26 | 0.049 | 0.40 | 0.48 | 0.021 | 0.002 | 11.9 | 0.55 | 0.003 | 0.18 | 0.139 | — | 0.188 | 2.84 | Comparative Example |
| 27 | 0.043 | 0.38 | 0.38 | 0.023 | 0.002 | 9.8 | 0.13 | 0.002 | 0.22 | 0.110 | — | 0.153 | 2.56 | Comparative Example |
| 28 | 0.035 | 0.43 | 0.33 | 0.036 | 0.001 | 14.6 | 0.13 | 0.004 | 0.32 | 0.129 | — | 0.164 | 3.69 | Comparative Example |
| 29 | 0.042 | 0.34 | 0.40 | 0.036 | 0.003 | 13.5 | 0.19 | 0.003 | 0.03 | 0.135 | — | 0.177 | 3.21 | Comparative Example |
| 30 | 0.037 | 0.41 | 0.32 | 0.038 | 0.001 | 13.0 | 0.17 | 0.005 | 0.63 | 0.082 | — | 0.119 | 2.22 | Comparative Example |
| 31 | 0.039 | 0.40 | 0.31 | 0.021 | 0.003 | 12.7 | 0.06 | 0.005 | 0.12 | 0.047 | — | 0.086 | 1.21 | Comparative Example |
| 32 | 0.040 | 0.31 | 0.49 | 0.035 | 0.002 | 12.7 | 0.19 | 0.003 | 0.33 | 0.214 | — | 0.254 | 5.35 | Comparative Example |
| 33 | 0.041 | 0.39 | 0.30 | 0.022 | 0.001 | 12.2 | 0.19 | 0.003 | 0.16 | 0.129 | Cu: 0.23 | 0.170 | 3.15 | Comparative Example |
| 34 | 0.036 | 0.45 | 0.36 | 0.034 | 0.002 | 12.4 | 0.15 | 0.003 | 0.31 | 0.057 | — | 0.093 | 1.58 | Comparative Example |
| 35 | 0.089 | 0.44 | 0.32 | 0.032 | 0.003 | 13.5 | 0.05 | 0.003 | 0.19 | 0.077 | — | 0.166 | 0.87 | Comparative Example |
| 36 | 0.045 | 0.30 | 0.32 | 0.034 | 0.001 | 12.5 | 0.16 | 0.005 | 0.18 | 0.111 | — | 0.156 | 2.47 | Comparative Example |
| 37 | 0.045 | 0.30 | 0.32 | 0.034 | 0.001 | 12.5 | 0.16 | 0.005 | 0.18 | 0.111 | — | 0.156 | 2.47 | Comparative Example |
| 38 | 0.045 | 0.30 | 0.32 | 0.034 | 0.001 | 12.5 | 0.16 | 0.005 | 0.18 | 0.111 | — | 0.156 | 2.47 | Comparative Example |
| 39 | 0.045 | 0.30 | 0.32 | 0.034 | 0.001 | 12.5 | 0.16 | 0.005 | 0.18 | 0.111 | — | 0.156 | 2.47 | Comparative Example |
| 40 | 0.037 | 0.42 | 0.30 | 0.036 | 0.003 | 10.9 | 0.18 | 0.004 | 0.38 | 0.189 | — | 0.226 | 5.11 | Comparative Example |

TABLE 2

| Steel No. | Production conditions: Quenching temperature (° C.) | Quenching holding time (s) | Tempering temperature (° C.) | Tempering holding time (s) | Amount of martensite | Number of precipitates | Evaluation results: Tensile strength | Proof stress | Elongation | Bead workability | Corrosion resistance | Remarks |
|---|---|---|---|---|---|---|---|---|---|---|---|---|
| 1 | 1030 | 30 | 250 | 30 | Good | Good | Good | Good | Good | Good | Good | Example |
| 2 | 1030 | 30 | 300 | 30 | Excellent | Excellent | Good | Good | Good | Excellent | Good | Example |
| 3 | 980 | 300 | 200 | 600 | Excellent | Good | Good | Good | Good | Good | Good | Example |
| 4 | 1030 | 30 | 300 | 30 | Good | Good | Good | Good | Good | Good | Good | Example |
| 5 | 1030 | 30 | 350 | 30 | Excellent | Excellent | Good | Good | Good | Excellent | Good | Example |
| 6 | 1050 | 20 | 300 | 30 | Excellent | Excellent | Good | Good | Good | Excellent | Good | Example |
| 7 | 1000 | 30 | 350 | 30 | Excellent | Good | Good | Good | Good | Good | Good | Example |
| 8 | 1030 | 30 | 250 | 300 | Good | Good | Good | Good | Good | Good | Good | Example |
| 9 | 1100 | 5 | 300 | 30 | Good | Good | Good | Good | Good | Good | Good | Example |
| 10 | 1030 | 30 | 300 | 30 | Excellent | Excellent | Good | Good | Good | Excellent | Good | Example |
| 11 | 1080 | 30 | 200 | 600 | Excellent | Excellent | Good | Good | Good | Excellent | Good | Example |
| 12 | 1000 | 30 | 400 | 5 | Good | Good | Good | Good | Good | Good | Good | Example |
| 13 | 1050 | 30 | 300 | 30 | Excellent | Excellent | Good | Good | Good | Excellent | Good | Example |
| 14 | 1050 | 30 | 300 | 30 | Good | Good | Good | Good | Good | Good | Good | Example |
| 15 | 1030 | 20 | 350 | 30 | Good | Good | Good | Good | Good | Good | Good | Example |
| 16 | 1030 | 30 | 250 | 120 | Excellent | Good | Good | Good | Good | Good | Good | Example |
| 17 | 1000 | 30 | 250 | 120 | Good | Good | Good | Good | Good | Good | Good | Example |
| 18 | 980 | 600 | 350 | 30 | Good | Good | Good | Good | Good | Good | Good | Example |
| 19 | 1050 | 30 | 400 | 20 | Good | Excellent | Good | Good | Good | Excellent | Good | Example |
| 20 | 1000 | 30 | 200 | 30 | Good | Good | Good | Good | Good | Good | Good | Example |
| 21 | 1030 | 30 | 250 | 30 | Good | Poor | Good | Good | Poor | Poor | Poor | Comparative Example |
| 22 | 1050 | 30 | 300 | 30 | Poor | Good | Poor | Poor | Good | Good | Good | Comparative Example |
| 23 | 1050 | 30 | 250 | 30 | Good | Poor | Good | Good | Poor | Poor | Poor | Comparative Example |
| 24 | 1050 | 30 | 400 | 30 | Poor | Good | Poor | Poor | Poor | Poor | Good | Comparative Example |

TABLE 2-continued

| | Production conditions | | | | | | Evaluation results | | | | | |
|---|---|---|---|---|---|---|---|---|---|---|---|---|
| Steel No. | Quenching temperature (° C.) | Quenching holding time (s) | Tempering temperature (° C.) | Tempering holding time (s) | Amount of martensite | Number of precipitates | Tensile strength | Proof stress | Elongation | Bead workability | Corrosion resistance | Remarks |
| 25 | 1030 | 30 | 300 | 30 | Good | Good | Good | Good | Poor | Poor | Good | Comparative Example |
| 26 | 1050 | 30 | 250 | 30 | Excellent | Excellent | Good | Good | Poor | Poor | Good | Comparative Example |
| 27 | 1050 | 30 | 300 | 30 | Excellent | Excellent | Good | Good | Good | Excellent | Poor | Comparative Example |
| 28 | 1030 | 30 | 350 | 30 | Poor | Good | Poor | Poor | Good | Good | Good | Comparative Example |
| 29 | 1030 | 30 | 300 | 30 | Good | Poor | Good | Good | Good | Poor | Good | Comparative Example |
| 30 | 1080 | 30 | 200 | 30 | Good | Poor | Good | Good | Good | Poor | Good | Comparative Example |
| 31 | 1030 | 30 | 250 | 30 | Poor | Good | Poor | Poor | Good | Good | Good | Comparative Example |
| 32 | 1000 | 30 | 300 | 30 | Good | Poor | Good | Good | Poor | Poor | Poor | Comparative Example |
| 33 | 1050 | 30 | 250 | 30 | Good | Good | Good | Good | Good | Poor | Good | Comparative Example |
| 34 | 1000 | 30 | 200 | 30 | Poor | Good | Poor | Poor | Good | Good | Good | Comparative Example |
| 35 | 1000 | 30 | 350 | 30 | Good | Good | Good | Good | Poor | Good | Poor | Comparative Example |
| 36 | 1130 | 30 | 300 | 30 | Excellent | Good | Good | Good | Poor | Poor | Good | Comparative Example |
| 37 | 930 | 30 | 300 | 30 | Poor | Excellent | Poor | Poor | Good | Excellent | Good | Comparative Example |
| 38 | 1030 | 30 | 100 | 30 | Excellent | Excellent | Good | Good | Poor | Poor | Good | Comparative Example |
| 39 | 1030 | 30 | 500 | 30 | Poor | Good | Poor | Poor | Good | Good | Poor | Comparative Example |
| 40 | 980 | 2 | 250 | 30 | Good | Poor | Good | Good | Good | Poor | Good | Comparative Example |

As can be seen from Table 2, Examples No. 1 to 20 all had excellent strength (tensile strength, proof stress) and workability (elongation, bead workability), and sufficient corrosion resistance. In Examples No. 2, 5, 6, 10, 11, 13, and 19 in which the V content was limited to a more preferable range (0.15% to 0.25%) and the quenching treatment conditions and the tempering treatment conditions were limited to more preferable ranges (quenching temperature: 1000° C. to 1100° C., quenching holding time: 20 sec or more, tempering holding time: 20 sec or more), the number of precipitates with a major axis length of 200 nm or more was 15 or less per 100 $\mu m^2$, and the bead workability was particularly good.

In Comparative Example No. 21 (equivalent to SUS403) in which the C content was high and outside the appropriate range and V was not contained, the elongation and the corrosion resistance were evaluated as poor. Besides, many coarse precipitates with a major axis length of 200 nm or more formed, and the bead workability was evaluated as poor.

In Comparative Example No. 22 in which the C content was low and outside the appropriate range, the tensile strength and the proof stress were evaluated as poor.

In Comparative Example No. 23 in which the C content was high and outside the appropriate range, the elongation and the corrosion resistance were evaluated as poor. Besides, many coarse precipitates with a major axis length of 200 nm or more formed, and the bead workability was evaluated as poor.

In Comparative Example No. 24 in which the Si content was high and outside the appropriate range, the tensile strength, the proof stress, the elongation, and the bead workability were evaluated as poor.

In Comparative Example No. 25 in which the Mn content was high and outside the appropriate range and Comparative Example No. 26 in which the Ni content was high and outside the appropriate range, the elongation and the bead workability were evaluated as poor.

In Comparative Example No. 27 in which the Cr content was low and outside the appropriate range, the corrosion resistance was evaluated as poor.

In Comparative Example No. 28 in which the Cr content was high and outside the appropriate range, the strength and the proof stress were evaluated as poor.

In Comparative Example No. 29 in which the V content was low and outside the appropriate range and Comparative Example No. 30 in which the V content was high and outside the appropriate range, many coarse precipitates with a major axis length of 200 nm or more formed, and the bead workability was evaluated as poor.

In Comparative Example No. 31 in which the N content was low and outside the appropriate range and C %+N % was low and outside the appropriate range, the tensile strength and the proof stress were evaluated as poor.

In Comparative Example No. 32 in which the N content was high and outside the appropriate range, the elongation and the corrosion resistance were evaluated as poor. Besides, many coarse precipitates with a major axis length of 200 nm or more formed, and the bead workability was evaluated as poor.

In Comparative Example No. 33 in which the Cu content was high and outside the appropriate range, the bead workability was evaluated as poor.

In Comparative Example No. 34 in which C %+N % was low and outside the appropriate range, the tensile strength and the proof stress were evaluated as poor.

In Comparative Example No. 35 in which N %<C %, the elongation and the corrosion resistance were evaluated as poor.

In Comparative Example No. 36, due to excessively high quenching temperature, the bead workability and the elongation were evaluated as poor.

In Comparative Example No. 37, due to excessively low quenching temperature, the tensile strength and the proof stress were evaluated as poor.

In Comparative Example No. 38, due to excessively low tempering temperature, the elongation and the bead workability were evaluated as poor.

In Comparative Example No. 39, due to excessively high tempering temperature, the tensile strength and the proof stress were evaluated as poor. In Comparative Example No. 39, the corrosion resistance was also evaluated as poor.

In Comparative Example No. 40, due to excessively short quenching holding time, many coarse precipitates with a major axis length of 200 nm or more formed, and the bead workability was evaluated as poor.

INDUSTRIAL APPLICABILITY

The martensitic stainless steel sheet according to the present disclosure is excellent in all of strength (tensile strength, proof stress), workability (elongation, bead workability), and corrosion resistance, and thus is suitable as gasket members. The martensitic stainless steel sheet according to the present disclosure is also suitable for use in parts that require spring property.

The invention claimed is:

1. A martensitic stainless steel sheet comprising a chemical composition containing, in mass %, C: 0.035% to 0.090%,
Si: 0.01% to 1.0%,
Mn: 0.01% to 0.90%,
P: 0.050% or less,
S: 0.050% or less,
Cr: 10.0% to 14.0%,
Ni: 0.01% to 0.40%,
Al: 0.001% to 0.50%,
V: 0.05% to 0.50%, and
N: 0.050% to 0.20%, with the balance being Fe and inevitable impurities, wherein a content of C and a content of N in the chemical composition satisfy the following Formulas (1) and (2):

$$C\ \% + N\ \% \geq 0.10\% \quad (1)$$

$$N\ \% \geq C\ \% \quad (2)$$

where C % and N % respectively denote the content of C and the content of N in steel in mass %, the number of precipitates with a major axis length of 200 nm or more in a surface layer of the martensitic stainless steel sheet is 25 or less per 100 $\mu m^2$, and the martensitic stainless steel sheet has a tensile strength of 1300 MPa or more, a proof stress of 1100 MPa or more, and an elongation of 8.0% or more.

2. The martensitic stainless steel sheet according to claim 1, wherein the chemical composition further contains, in mass %, one or more selected from the group consisting of Mo: 0.01% to 0.50%,
Cu: 0.01% to 0.15%, and
Co: 0.01% to 0.50%.

3. The martensitic stainless steel sheet according to claim 1, wherein the chemical composition further contains, in mass %, one or more selected from the group consisting of Ti: 0.01% to 0.15%,
Nb: 0.01% to 0.15%, and
Zr: 0.01% to 0.15%.

4. The martensitic stainless steel sheet according to claim 1, wherein the chemical composition further contains, in mass %, one or more selected from the group consisting of B: 0.0002% to 0.0100%,
Ca: 0.0002% to 0.0100%, and
Mg: 0.0002% to 0.0100%.

5. The martensitic stainless steel sheet according to claim 2, wherein the chemical composition further contains, in mass %, one or more selected from the group consisting of Ti: 0.01% to 0.15%,
Nb: 0.01% to 0.15%, and
Zr: 0.01% to 0.15%.

6. The martensitic stainless steel sheet according to claim 2, wherein the chemical composition further contains, in mass %, one or more selected from the group consisting of B: 0.0002% to 0.0100%,
Ca: 0.0002% to 0.0100%, and
Mg: 0.0002% to 0.0100%.

7. The martensitic stainless steel sheet according to claim 3, wherein the chemical composition further contains, in mass %, one or more selected from the group consisting of B: 0.0002% to 0.0100%,
Ca: 0.0002% to 0.0100%, and
Mg: 0.0002% to 0.0100%.

8. The martensitic stainless steel sheet according to claim 5, wherein the chemical composition further contains, in mass %, one or more selected from the group consisting of B: 0.0002% to 0.0100%,
Ca: 0.0002% to 0.0100%, and
Mg: 0.0002% to 0.0100%.

* * * * *